United States Patent [19]

King

[11] Patent Number: 4,786,083

[45] Date of Patent: Nov. 22, 1988

[54] TICKET PACK FOR PASSENGER TICKETS AND METHOD FOR ASSEMBLING SAME

[75] Inventor: Stephen H. King, Schaumburg, Ill.

[73] Assignee: Rand McNally & Company, Skokie, Ill.

[21] Appl. No.: 57,604

[22] Filed: Jun. 3, 1987

[51] Int. Cl.[4] ..... B42D 5/00; B42D 15/00; B42F 3/00; G09F 3/04

[52] U.S. Cl. ..... 281/15 R; 283/53; 283/65; 40/642

[58] Field of Search ..... 281/15 R, 48, 50; 283/1, 2, 53, 74, 81, 65; 40/10 R; 206/39, 39.4; 312/50; 402/80 R

[56] References Cited

U.S. PATENT DOCUMENTS

| | | | |
|---|---|---|---|
| 426,503 | 4/1890 | Keller | 283/53 |
| 736,810 | 8/1903 | Wynans | 281/15 R |
| 797,590 | 8/1905 | Loyster | 283/53 |
| 1,419,066 | 6/1922 | Lick | 283/53 |
| 3,174,232 | 3/1965 | Beauvais | 281/15 R |
| 3,954,287 | 5/1976 | Osteen | 281/15 R |
| 4,338,739 | 7/1982 | Greenberger | 40/10 R |
| 4,539,766 | 9/1985 | Fast | 40/10 R |

FOREIGN PATENT DOCUMENTS

| | | | |
|---|---|---|---|
| 639202 | 6/1950 | United Kingdom | 283/65 |

*Primary Examiner*—Frank T. Yost
*Assistant Examiner*—Paul M. Heyrana, Sr.
*Attorney, Agent, or Firm*—Dressler, Goldsmith, Shore, Sutker & Milnamow, Ltd.

[57] ABSTRACT

In a ticket pack, a plurality of ATB tickets and a support panel assembled to each other with tabs on stub portions of the tickets being received by slots of the support panel. No staples are required. Main portions of selected tickets, if torn off, may be slipped into other slots of the support panel.

5 Claims, 1 Drawing Sheet

TICKET PACK FOR PASSENGER TICKETS AND METHOD FOR ASSEMBLING SAME

BACKGROUND OF THE INVENTION

This invention pertains to a ticket pack for passenger tickets, as used for passenger travel, and to a method of assembling such a pack.

In recent years, ATB tickets made of card stock have come into widespread use. "ATB" is an acronym for an "automated ticket and boarding pass." Typically, an ATB ticket is divided by a first line of perforations into a stub portion and a main portion. The main portion may be further divided by another line of perforations into a passenger coupon and a boarding pass. The passenger coupon may serve also as a baggage check.

As pre-printed with standard information, ATB tickets are available from Rand McNally & Company of Skokie, Ill. Automated machines are used to overprint variable information on the pre-printed tickets, such as destinations, fares, and the like, and to dispense the overprinted tickets.

Conventional practices have been for a passenger to receive a set of such tickets, one providing a passenger coupon and a boarding pass for each trip and another providing a receipt for the passenger, and for the tickets constituting the set to be tamped into a compact stack and then assembled into a folder by means of staples passing through the stub portions of the stacked tickets and through a panel of the folder. The main portions of selected tickets may be later torn off and slipped into a pocket formed in the folder.

Because ticket agents and other personnel involved with passenger travel are required to handle vast numbers of passenger tickets, improvements in ticket-handling practices promise to provide enormous benefits to such personnel, their employers, and the passenger with whom such personnel and their employers deal, not only in terms of cost savings but also in terms of employee morale and passenger satisfaction.

Herefore, there has been a need, to which this invention is addressed, for improvements enabling ticket packs to be assembled with greater convenience to ticket agents and other personnel involved with passenger travel and to passengers.

SUMMARY OF THE INVENTION

It is a principal object of this invention to provide an improved ticket pack for passenger tickets. It is an additional object of this invention to provide an improved method of assembling such a ticket pack.

Broadly, a ticket pack according to this invention comprises a plurality of tickets of uniform shape and a support panel, to which the tickets are assembled in a unique manner. The tickets may be ATB tickets, as described above.

Each ticket is made of card stock. A line of weakness, such as a line of perforations, divides each ticket into a stub portion with opposite ends and a main portion, which is adapted to be torn from the stub portion along the line of weakness. Each stub portion forms a tab on each end of such stub portion. Preferably, each ticket defines a rectangular outline around its peripheral edge, and the tabs of each ticket fit within the rectangular outline of such ticket. Preferably, each ticket has a notch terminating the line of weakness at each end of the line of weakness so as to form a tab at each end of the stub portion. The tickets are stacked on one another so that the lines of weakness of the tickets overlie one another.

The support panel has a pair of slots, which span a distance less than the distance between the ends of the tabs. If the tabs of each ticket fit within a rectangular outline defined by the peripheral edge of such ticket, the pair of slots span a distance approximately equal to the distance between the ends of the line of weakness of each ticket. The tabs are inserted into the slots of the pair so that each slot of the pair receives the tab on one end of the stub portion of each ticket, as by curling the stacked tickets so as to facilitate insertion and releasing the curled tickets after insertion.

No staples are required. Such tickets may be easily added, removed, or rearranged, as desired.

Preferably, the support panel has a third slot, which is adapted to allow the main portion of a selected ticket, if torn from the stub portion of the selected ticket, to be slipped through the third slot until the main portion of the selected ticket engages at least one of the tabs extending through the slots of the pair. The main portion of the selected ticket may provide a passenger coupon and a boarding pass for a given trip.

Additionally, the ticket pack may comprise a cover panel, which is attached to the support panel along a folding line, and which is adapted to cover the tickets assembled to the support panel. Together, the support panel and the cover panel serve as a folder protecting the tickets.

These and other objects, features, and advantages of this invention will be better understood from the following description of a preferred embodiment of this invention, with reference to the accompanying drawings.

DETAILED DESCRIPTION OF PREFERRED EMBODIMENT

Figure 4:
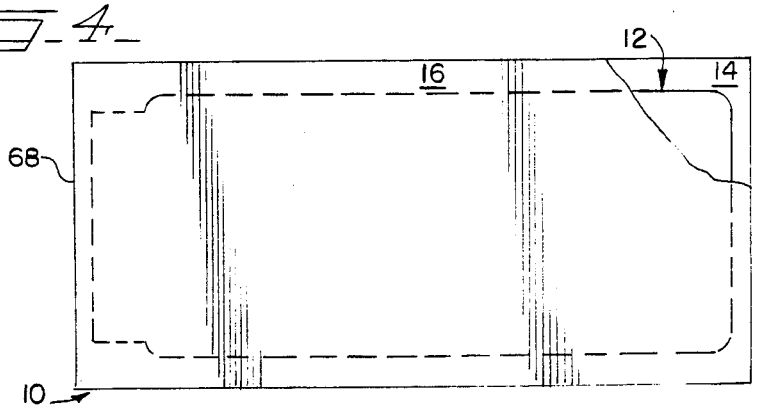
FIG. 4 is a top plan view of the ticket pack of FIG. 2, FIG. 4 showing the cover panel folded over the support panel.

Broadly, as shown in the drawings, a ticket pack 10 constituting a preferred embodiment of this invention comprises a plurality of tickets 12, which constitute a set to be given to a passenger, a support panel 14, to which the tickets 12 are assembled in a unique manner to be hereinafter described, and a cover panel 16, which is attached to the support panel 14, as described below, so that the support panel 14 and the cover panel 16 serve as a folder protecting the tickets 12. The cover panel 16, as shown folded out and in a fragmentary form in FIGS. 1 and 2, and in a more complete form in FIG. 4, is generally the same in size and dimension as the support panel 14. The set may comprise two, three, or more of the tickets 12. As shown, the set comprises at least three of the tickets 12, four tickets being shown in FIG. 1.

The tickets 12, which have a uniform shape fitting within a rectangular outline defined by the peripheral edges of the tickets 12 but having rounded corners, are made of card stock, which is stiff but flexible. A line of perforations constituting a line of weakness 20 divides each of the tickets 12 into a narrow stub portion 22, which has a first end 24 and a second end 26, and a main portion 28, which is adapted to be torn from the stub portion 22 along the line of weakness 20.

Each ticket 12 has a notch 30 terminating the line of weakness 20 at its first end 32 and a notch 34 terminating the line of weakness 20 at its second end 36. On each ticket 12, the notch 30 forms a tab 38 at the first end 24 of the stub portion 22, and the notch 34 forms a tab 40 at the second end 26 of the stub portion 22. Another line of perforations 42 divides the main portion 28 of each ticket 12 into a passenger coupon 44 and a boarding pass 46. The passenger coupon 44 may serve also as a baggage check.

The tickets 12 may be ATB tickets, as presently available from Rand McNally & Company of Skokie, Ill., and as currently used with staple-type systems for assembling them into ticket packs. As described below, the tickets 12 are combined with the support panel 14 in a unique assembly, which does not require stapling.

The support panel 14, which may be made of stiff paper or card stock, has a pair of slots 48, 50, which span a distance approximately equal to the distance between the ends 32, 36, of the line of weakness 20. The distance spanned by the slots 48, 50, is measured from an outer edge 52 of the slot 48 to an outer edge 54 of the slot 50. Preferably, the distance spanned by the slots 48, 50, is slightly greater than the distance between the ends 32, 36, of the line of weakness 20 of each ticket 20. Each of the slots 48, 50, has a width slightly greater than the width of each of the tabs 38, 40, as measured between the ends 32, 36, of the line of weakness 20 and the edge 56 of the stub portion 22. The widths of the slots 48, 50, and the widths of the tabs 38, 40, are measured in parallel relation to the edges 52, 54. As shown, the slots 48, 50, are enlarged vertically (as shown in the drawings) so as to facilitate the assembly of the tickets 12 and the support panel 14 to each other. The degree of enlargement need not be great and the shape of the enlargement may vary.

Figure 1:
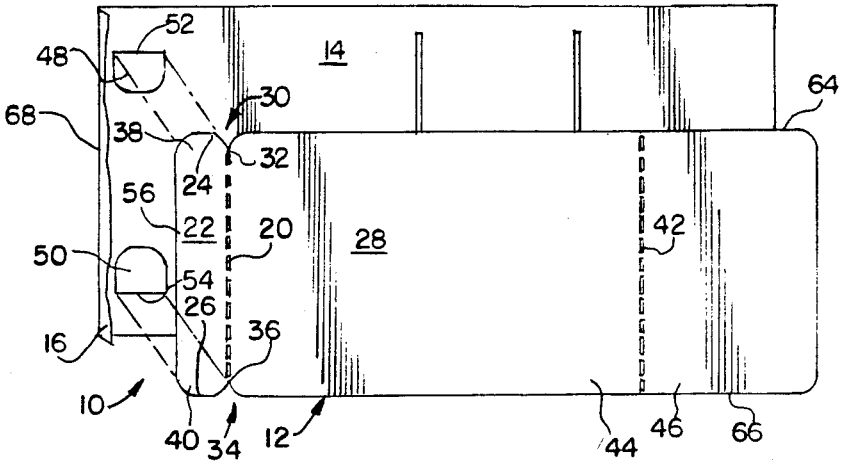
FIG. 1 is a top plan view of a set of tickets and a support panel, which when assembled into a ticket pack constitute a preferred embodiment of this invention, a cover panel being broken away to reveal other features.
Figure 2:
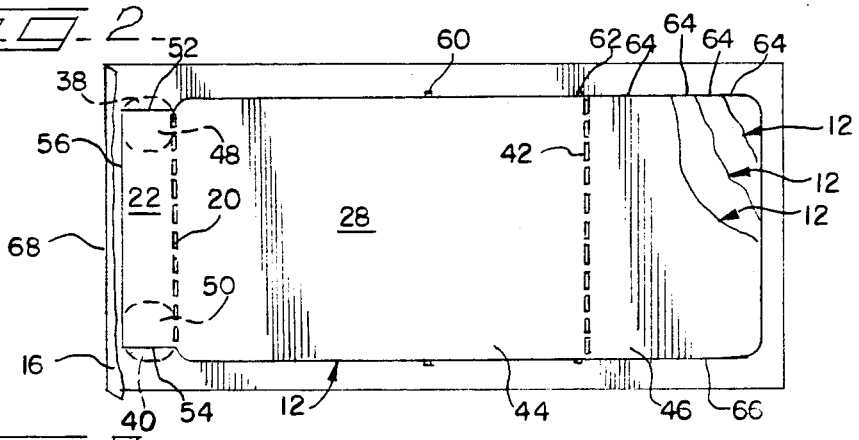
FIG. 2 is a top plan view of a ticket pack comprising the tickets and the support panel of FIG. 1, as assembled.

After the tickets 12 have been issued and then sorted into a desired sequence, the tickets 12 are tamped into a compact stack, in which four tickets 12 are shown in FIG. 1, so that the lines of weakness 20 of the tickets 12 overlie one another. Hence, the tabs 38 overlie one another, and the tabs 40 overlie one another. Next, the tabs 38 of the stacked tickets 12 are inserted into the slot 48 of the support panel 14, and the tabs 40 of the stacked tickets 12 are inserted into the slot 50 of the support panel 14. Because the tickets 12 are made of card stock, which is stiff but flexible, the tickets 12 may be manually curled (as by squeezing the stack as and where indicated by the arrows A in FIG. 1) so as to facilitate insertion of the tabs 38, 40 into the slots 48, 50. When released after insertion of the tabs 38, 40, into the slots 48, 50, the tickets 12 tend to flatten. Because the slot 48 receives the tabs 38 of the stacked tickets 12 and the slot 50 receives the tabs 40 of the stacked tickets 12, there is no need to staple the stub portions 22 of the tickets 12 to the support panel 14.

Figure 3:
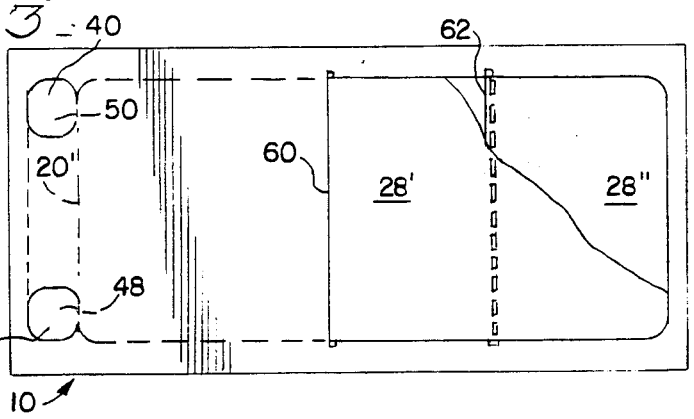
FIG. 3 is a bottom plan view of the ticket pack of FIG. 2, the main portions of two tickets having being torn off and having been slipped through respective slots in the support panel, the cover panel being hidden by the support panel.

The support panel 14 is provided with a third slot 60 and fourth slot 62, each being slightly longer than the width of each of the tickets 12 between their top edges 64 and their bottom edges 66. As shown in FIG. 3, which contemplates that at least three tickets 12 are included in the ticket pack 10, the main portion 28' of a selected one of the tickets 12, as torn from the stub portion 22 of the same ticket, can be slipped into the slot 60 until the main portion 28', at its line of weakness 20' where the main portion 28' has been torn from the stub portion 22 of the same ticket, engages one or more of the tabs 38 extending through the slots 48, one or more of the tabs 40 extending through the slot 50, or both. The stub portion 22 from which the main portion 28' has been torn may be left with its tabs extending through the slots 48, 50, or may be removed, as desired. Similarly, the main portion 28'' of a different one of the tickets 12 can be slipped into the slot 62 until the main portion 28'' engages one or more of the tabs 38 extending through the slots 48, one or more of the tabs 40 extending through the slots 50, or both. Thus, the main portion 28' can provide the passenger coupon and a boarding pass for an outboard trip, the main portion 28'' can provide the passenger coupon and a boarding pass for a return trip, and a remaining one of the tickets 12 can provide a receipt. Because of the slots 60, 62, it is not necessary to provide separate pockets for the main portions 28', 28''.

As shown in FIG. 4, the cover panel 16, which is made in one piece with the support panel 14, is attached to the support panel 14 along a folding line 64 constituting one edge of each such panel, preferably a narrow edge near the slots 48, 50. When folded over the support panel 14, as shown in FIG. 4, the cover panel 16 covers support panel 14 so as to cover such portions of the tickets 12 as are between the support panel 14 and the cover panel 16, i.e., the main portions 28 therebetween and the stub portions 22 (but for the tabs 38, 40) therebetween. Together, the support panel 14 and the cover panel 16 serve as a folder protecting the tickets 12. If the cover panel 16 is not used, the support panel 14 and the tickets 12 assembled to the support panel 14 may be instead inserted in a protective folder (not shown) made of stiff paper or card stock.

Typical dimensions for the tickets 12 are 8 inches in length including the stub portions 22, 7.375 inches in length excluding the stub portions 22, and 3.25 inches in width. Typical dimensions for the support panel 14 and for the cover panel 16 are 8.5 inches in length and 4 inches in width.

As mentioned above, no staples are required, and such tickets may be easily added, removed, or rearranged, as required. Because of the third and fourth slots receiving the main portions torn off selected tickets, it is not necessary to provide separate pockets. Thus, in contrast with stapled ticket packs, a ticket pack according to this invention may be assembled with greater convenience to ticket-handling personnel and to passengers.

It will be apparent to those skilled in the art that modifications and variations of, the embodiment illustrated may be made without departing from the spirit and scope of the present invention. Therefore, it is intended by the following claims to cover all modifications, variations, and improvements within the scope and spirit of this invention.

What is claimed is:

1. A ticket pack for passenger tickets, the ticket pack comprising (a) a plurality of tickets of a uniform shape, each ticket being made of card stock and having a line of weakness with opposite ends, the line of weakness of each ticket dividing such ticket into a stub portion with opposite ends and a main portion separable from the stub portion along the line of weakness, each stub portion forming a tab on each end of such stub portion, the tabs projecting oppositely, (b) a support panel having a pair of slots spanning a distance less than the distance between the ends of the tabs of each ticket, the tickets being stacked on one another so that the lines of weakness of the tickets overlie one another, the tabs being inserted into the slots of the pair so that each slot of the pair receives the tab on one end of the stub portion of each ticket, said support panel having a third slot proportioned to allow the main portion of a selected one of the tickets, if torn from the stub portion of the selected one of the tickets, to be slipped through the third slot until an end of the main portion of the selected one of the tickets engages at least one of the tabs extending through the slots of the pair.

2. The ticket pack of claim 1 further comprising (c) a cover panel attached to the support panel along a folding line and positioned so as to cover such portions of the tickets as are between the support and cover panels.

3. A method of assembling a ticket pack for passenger tickets comprising the steps of (a) providing a plurality of tickets of a uniform shape, each ticket being made of card stock and having a line of weakness dividing such ticket into a stub portion and a main portion, each stub portion forming a tab on each end of such stub portion, the tabs projecting oppositely, (b) providing a support panel having a pair of slots spanning a distance less than the distance between the ends of the tabs of each ticket, (c) stacking the tickets so that the lines of weakness of the tickets overlie one another, (d) inserting the tabs on the ends of the stub portions of the stacked tickets into the slots of the pair so that each slot of the pair receives the tab on one end of the stub portion of each of the stacked tickets, (e) tearing the main portion of a selected one of the tickets from the stub portion of the selected one of the tickets, and (f) slipping the main portion of the selected one of the tickets through a third slot in the support panel until an end of the main portion of the selected one of the tickets engages at least one of the tabs extending through the slots of the pair.

4. The ticket pack of claim 1 wherein the stub portion and the main portion of each ticket define a rectangular outline within which the tabs of such ticket lie.

5. The ticket pack of claim 4 wherein each ticket has a pair of notches, each notch terminating the line of weakness of such ticket at one end of the line of weakness of such ticket so as to form the tabs at the ends of the stub portion of such ticket, and wherein the pair of slots span a distance approximately equal to the distance between the notches terminating the ends of the line of weakness of each ticket.

* * * * *